US007389077B2

(12) United States Patent
Berkes et al.

(10) Patent No.: US 7,389,077 B2
(45) Date of Patent: Jun. 17, 2008

(54) CHARGE CONTROL FOR FUSER ROLL TO PREVENT PRINT HISTORY RELATED MARKS ON COPY

(75) Inventors: John S. Berkes, Fairport, NY (US); Gerald M. Fletcher, Pittsford, NY (US); Brendan Kunzmann, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 240 days.

(21) Appl. No.: 11/314,573

(22) Filed: Dec. 21, 2005

(65) Prior Publication Data

US 2007/0140753 A1 Jun. 21, 2007

(51) Int. Cl.
*G03G 15/20* (2006.01)

(52) U.S. Cl. ..... 399/324; 399/327

(58) Field of Classification Search ..... 399/324–327
See application file for complete search history.

(56) References Cited

U.S. PATENT DOCUMENTS 4,935,785 A * 6/1990 Wildi et al. ..... 430/124.23

FOREIGN PATENT DOCUMENTS

JP 09311572 A * 12/1997

* cited by examiner

*Primary Examiner*—Ryan Gleitz
(74) *Attorney, Agent, or Firm*—James J. Ralabate

(57) ABSTRACT

The magnitude and polarity of the voltage on the fuser roll surface is controlled by either electronic charge application means or by applying charge control agents to the fuser. For negative toner, the fuser roll voltage must also be negative (and visa versa). This will repel the negative toner at the entrance to the fuser nip, prevent the toner from transferring to the fuser roll at the entrance of the fuser nip and preclude the formation of NVO and consequently prevent MOC.

2 Claims, 6 Drawing Sheets

| | |
|---|---|
| A | Charging station |
| B | Exposure station |
| C | Development and toner supplying station |
| D | Transfer station |
| E | Detack station |
| F | Fusing station |
| G | Cleaning station |

CHARGE CONTROL FOR FUSER ROLL TO PREVENT PRINT HISTORY RELATED MARKS ON COPY

CROSS REFERENCE

Illustrated in co-pending application now U.S. Ser. No. 11/314511 owned by the present assignee is a system for applying a wax coating on a fuser roll using the cleaning web as the wax applicator. This coating has the same or similar triboelectric properties as the wax used in the toner. The wax coating minimizes charge voltage compared to fuser rolls that do not have this wax coating. This application and the present application are filed concurrently herewith. The disclosure of now U.S. Ser. No. 11/314511 is incorporated herein by reference.

BACKGROUND

Fuser rolls used in electrostatic imaging systems generally comprise a cylindrical metal core coated with an elastomer such as Teflon™ (a ™ of DuPont). These fuser rolls are used in an imaging process wherein a photoconductor is selectively charged and optically exposed to form an electrostatic latent image on the photoconductor surface. Toner is deposited onto the image charged photoconductor surface. The toner has a charge; thus, it will adhere to the photoconductor surface in the areas of the electrostatic latent image. The toner in image-wise configuration is then transferred to the paper or other medium. The toned paper is heated by the fuser roll system and the toner is fused to the paper to form a permanent image. The imaged paper is then passed to a document output collection area or tray where the user collects the finished copy.

The fusing components used in electrostatic imaging system generally comprise a toner station, a fuser roll(s), a pressure roll(s), a cleaning web(s) and a paper transport means. It is common that a back-transfer of cleaned toner from a fusers cleaning web to the fuser roll will occur, thereby causing marks—on copy (MOC). This defect is especially common with Teflon based fuser rolls and easily transferred toners. This MOC is a function of prior image history (low area coverages are worse) and a function of fuser roll voltage. This fuser roll contamination of toner or by-products of toner usually takes the form of a film, which eventually builds up and adversely affects the performance and life of the fusing components. Not only can fuser roll toner contamination affect the fusing components but will also affect the quality and clarity of the image on the paper in contact with the fuser roll. Also, in some instances the contamination of the fuser roll is eventually transferred to the cleaning web and lessens the cleaning web's cleaning effectiveness. In addition, all fusers have non-visible offset (NVO) to some level which can be higher for toners which transfer easily. Fuser rolls which have poor conformance may not transfer the NVO back to the paper and this NVO ultimately results in MOC, which is visually objectionable has to be cleaned from the fuser roll (FR). The MOC level is dependent on print history which is most likely due in part to the image wise and non-uniform residual wax left on the fuser roll in high image coverage areas and depletion of wax in low image coverage regions. The presently disclosed system provides an effective means to minimize the NVO by inducing a negative voltage on the fuser roll to repel negative toner, and the opposite polarity for positive toner.

SUMMARY

The present embodiments disclosed and claimed herein provide an effective method for controlling the polarity of the tribo voltage induced on a fuser roll. Any suitable inducer may be used to apply charge control agents onto the fuser roll. The charge control agents may be applied to the fuser roll by chemical charge control inducers or electronic charge control inducers, or mixtures of these. In an embodiment, a convenient but not only way is to add charge control agents to the cleaning web since the cleaning web is always in contact with the fuser roll and will induce the proper voltage and polarity to the fuser roll to reduce or eliminate MOC. In another embodiment a separate chemical or electronic charge control agent applicator is located in the system where this separate applicator is in constant contact with the fuser roll and induces an electric charge on the fuser roll.

The charge control agent can be a suitable chemical charge control agent or an electrical charge control agent. In practice one would apply the charge control agent(s) to the fuser roll to control the magnitude and polarity of the voltage on the fuser roll surface. For negative toner, the fuser roll voltage must also be negative. This will repel the negative toner at the entrance to the fuser nip between the pressure and fuser rolls, prevent the toner from transferring to the fuser roll (FR) at the entrance of the fuser nip and preclude or minimize the formation of NVO and consequently prevent MOC. Thus, if the charge control agents induce a same charge as in the toner to the fuser roll, it will repel the toner; i.e. if the charge control agent(s) induce an electro negative charge to the fuser roll, it will repel electro negative charged toner, if positive charge is induced, it will repel electro positively charged toner. The cleaning web is used in one embodiment as the charge control agent applicator and it will not only induce the proper voltage and polarity to the fuser roll but can also apply a uniform wax toner release agent to the fuser roll. This combination will also reduce or eliminate NVO on the fuser roll.

Also, the proper voltage and polarity can be maintained on the web by any tribo induced methods (electrical) in lieu of or together with chemical induced methods to obtain the same results; i.e., repel residual toner and eliminate or reduce MOC.

Some chemical charge control agents useful in the present invention include dimethyl-dichloro-amonium-methyl-sulfate, DDAMS (+toner), Bontron E88 (−toner), Fluoro Slip 221 (™ of Shamrock Chemical Co.) and any other suitable chemical charge agents. The Fluoro Slip 22, induced a negative voltage on the fuser roll and totally eliminated the MOC. The Fluoro Slip 221 is a mixture of a polyethylene and a fluoropolymer like Teflon ® ( a trademark of DuPont). Bontron E-88 is a composition comprising Oxy-Carboxylic-Acid Complex. Bontron is a trademark of Orient Chemical EOM. Other Fluro Slip compositions such as #225, 421, 511, 605 and 731 MC are suitable as chemical charge control agents useful in present embodiments. Obviously various chemical control agents can be chosen to be suitable for the desired charge potential and/or to match the thermal requirements of individual fusers and toners. As earlier noted, an applicator other than the cleaning web may be used to apply the chemical charge control agent(s) to the fuser roll These other applicator(s) may be used anywhere in the system provided it is enabled to be in mechanical or electrical contact with the fuser roll.

Any suitable electrical means may be used to induce and control the desired magnitude and polarity of the voltage to the fuser roll. A negatively induced charge on the fuser roll by any suitable triboelectric or electric means will accomplish the desired effects of this invention. Suitable electric charge control agents include corona devices and biased charging rollers.

When embodiments of this invention are used, the electrostatic marking system comprises a charge, expose, development and paper transport stations. The development station comprises a toner supplying structure and at least one fuser roll. The fuser roll is in operative mechanical or electrical contact with a charge control inducer applicator. This inducer is enabled to modify and control the magnitude, voltage and polarity of the fuser roll. This inducer, as previously specified, is selected from the group consisting of chemical inducers, electronic inducers and mixtures of these. These inducers are enabled to at least reduce any image history effects, toner offset and marks on copy caused by an undesirable charge on said fuser roll.

DETAILED DESCRIPTION OF DRAWINGS AND PREFERRED EMBODIMENTS

Figure 1:
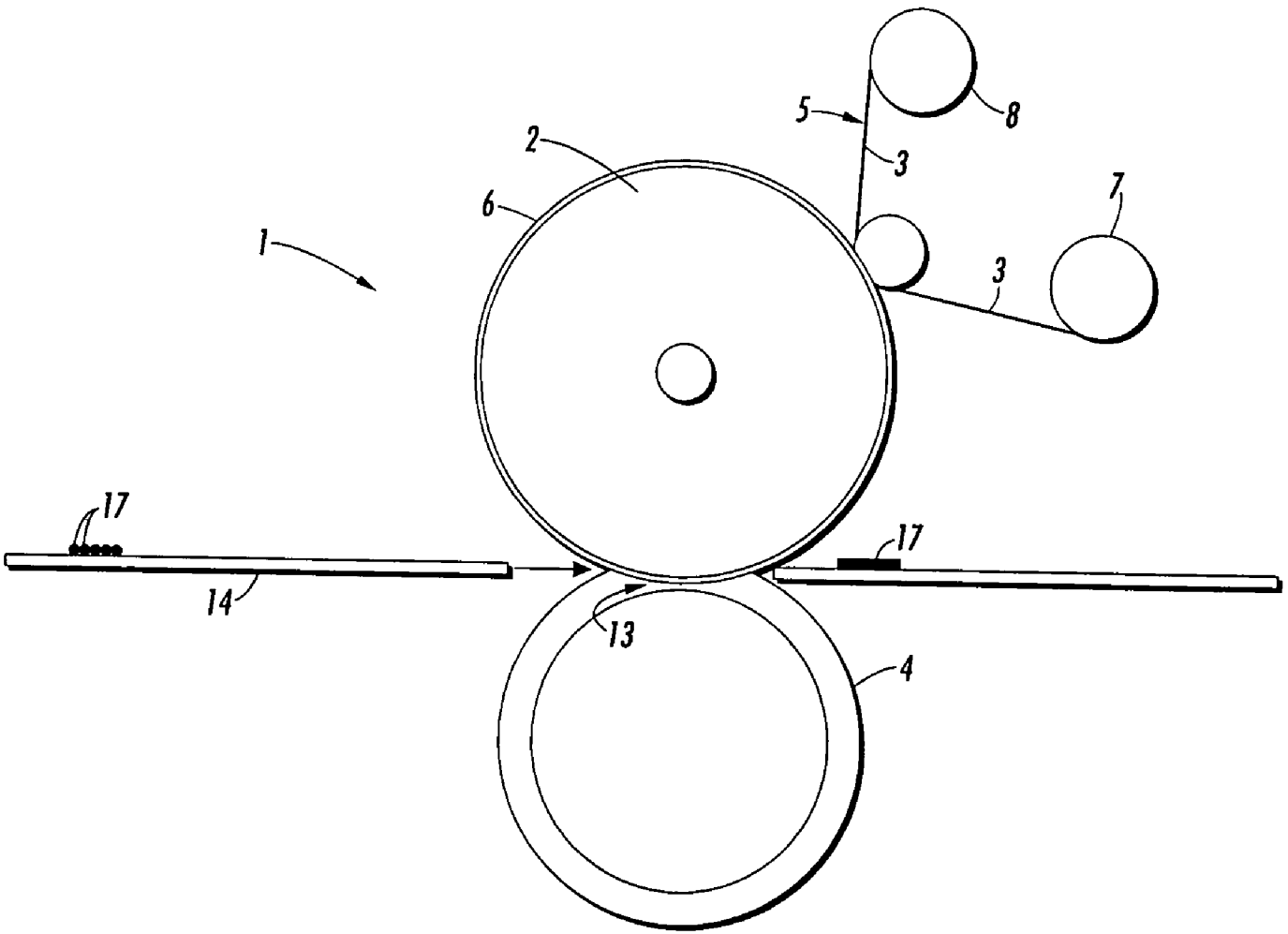
FIG. 1 illustrates one embodiment where a chemical inducer is applied by the cleaning web to the fuser roll.

In FIG. 1, a fuser system or apparatus 1 is shown having a fuser roll 2, a cleaning web 3, a pressure roll 4 and a paper-toner feed mechanism 14. The chemical charge control agents or inducers 5 are applied or coated by cleaning web 3 on the fuser roll 2 to control the magnitude and polarity of the voltage on the fuser roll surface to form a surface coating 6 containing said chemical inducer(s) 5. For a negative toner, the chemical inducer 5 must provide a negative potential on the surface of fuser roll 2 by coating 6. This will repel the negative toner at the entrance to the fuser nip 13 and prevent the toner 17 from transferring to the fuser roll 2 at the entrance of the fuser nip 13 and preclude the formation of NVO and consequently prevent MOC. MOC is especially common with Teflon-based fuser rolls 2 and easily transferable toners 17. As noted earlier, MOC is a strong function of prior image history and a function of fuser roll voltage. Impregnating the cleaning web 3 with a chemical charge control inducer 6 that is transferred to the fuser roll 2 will at least minimize and usually eliminate both image history effects and MOC in general. The chemical charge control inducer 6 is transferred to the fuser roll 2 inducing a negative charge on fuser roll 2 and reduce offset and MOC. If the toner 17 used is a negatively charged toner, then the chemical charge control inducer 6 will induce a negative charge on the fuser roll 2. If the toner 17 is a positively charged toner, then one would use a chemical charge control inducer 6 that will induce a positive charge on the fuser roll 2. Both positive and negative charged toners are well known in the prior art.

Figure 2:
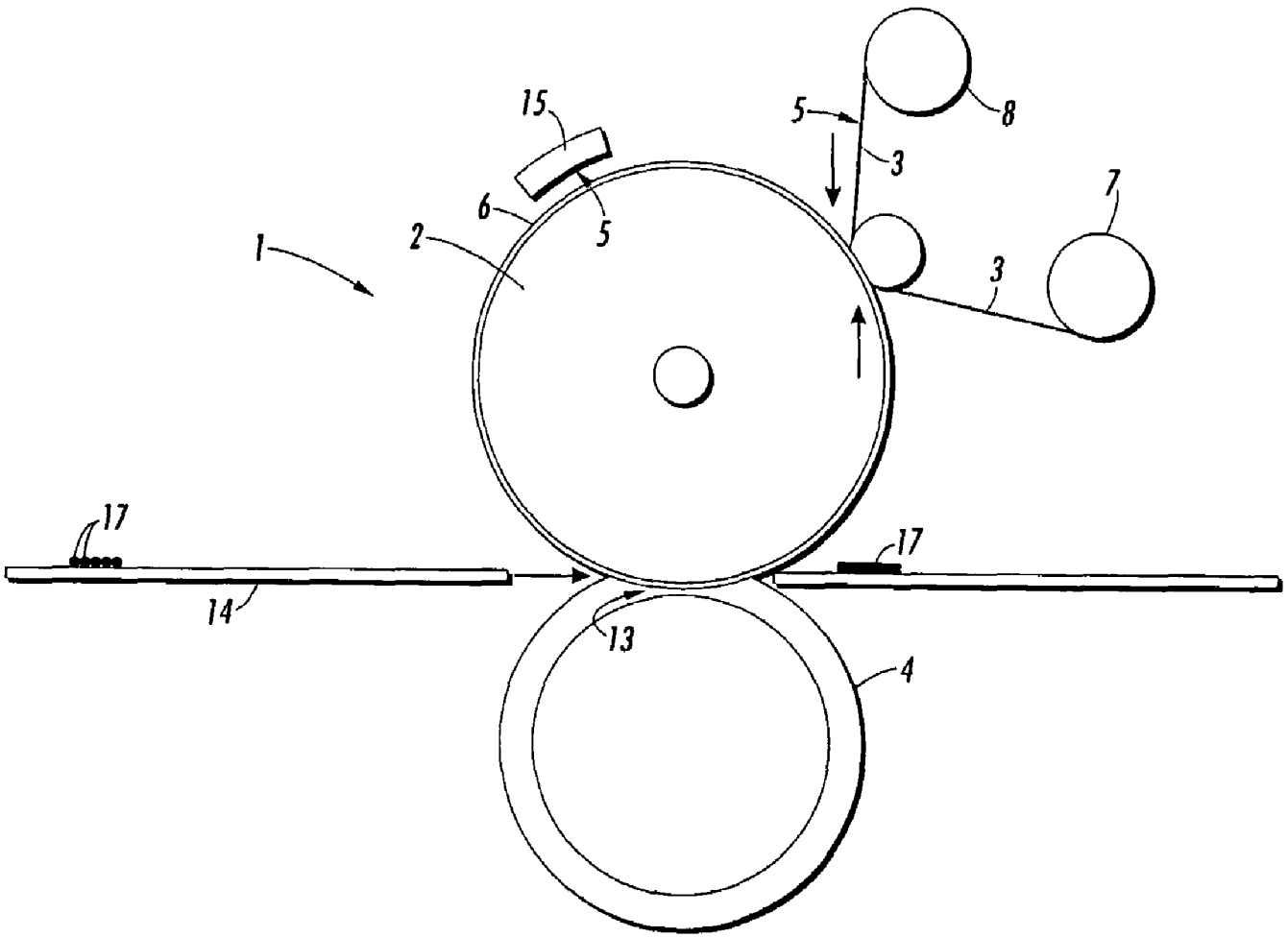
FIG. 2 illustrates another embodiment where a chemical inducer is applied by a separate applicator to control the polarity of the fuser roll.

In FIG. 2, the chemical control agent(s) 5 are applied onto the fuser roll 2 by a separate (from the web cleaner 3) applicator 15. This applicator 15 can be any suitable applicator enabled to properly coat the fuser roll with a chemical charge control inducer 6. In this embodiment, cleaning web 3 is not used as the applicator but merely functions as a cleaning means for fuser roll 2. All other aspects of the chemical charge control agent or inducer 6 as specified in FIG. 1 description are the same in this embodiment of FIG. 2.

Figure 3:
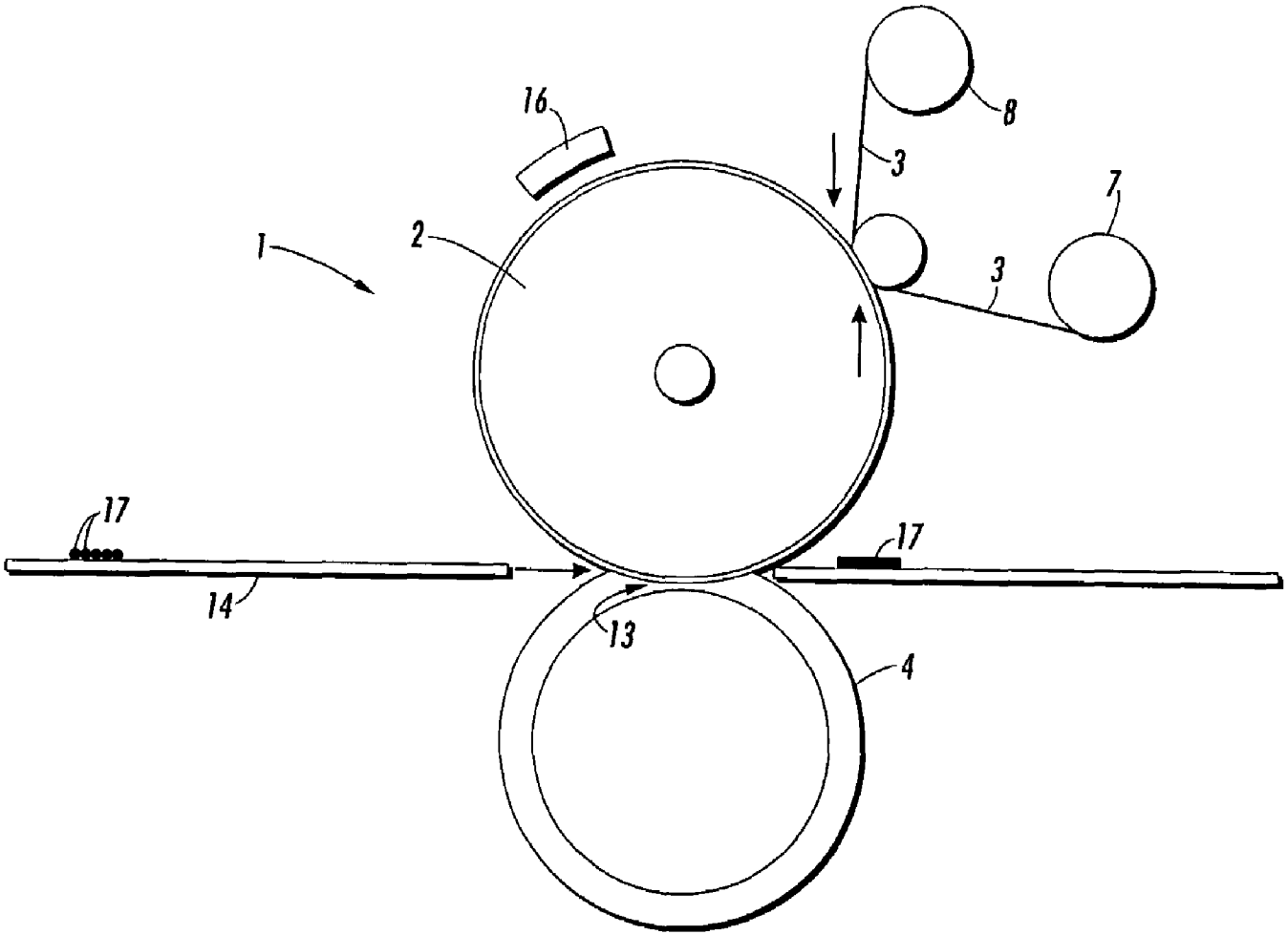
FIG. 3 illustrates in an embodiment the use of an electrical inducer to control the polarity of said fuser roll.

FIG. 3 illustrates the use of an electrical charge control agent or inducer 16 which could be a corona charger. A corona charger typically includes at least one very thin corona wire located within a housing shell. The corona wire is electrically coupled to a high voltage potential source to generate ions or charging current to charge a surface (such as fuser roll 2 surface) brought into close proximity with the corona wire. A grid may be located between the corona wire and the surface (of fuser roll 2) to be charged. The grid is held at a pre-selected (negative or positive) electrical potential to control the specific charge to be laid down on the fuser roll 2 surface. Thus, applicator or corona 16 is enabled to deposit either a positive or negative charge onto fuser roll 2 surface. If desirable, this electrical charge control inducer 16 may be used alone or together with a chemical inducer of FIG. 1 and FIG. 2. In FIG. 3 mixtures of electrical charge control inducers and chemical charge control inducers may be used; inducer 16 is used to introduce an electrical charge control inducer together with a chemical inducer introduced by cleaning web 3. As with a chemical charge control inducer, the electrical inducer 16 will transfer a charge (same as in toner) to the surface of fuser roll 2 and will minimize and, in most cases, eliminate both image history effects on the fuser roll 2 and MOC on the print. This will repel the negative (or positive) toner at the entrance to fuser nip 13.

Figure 4:
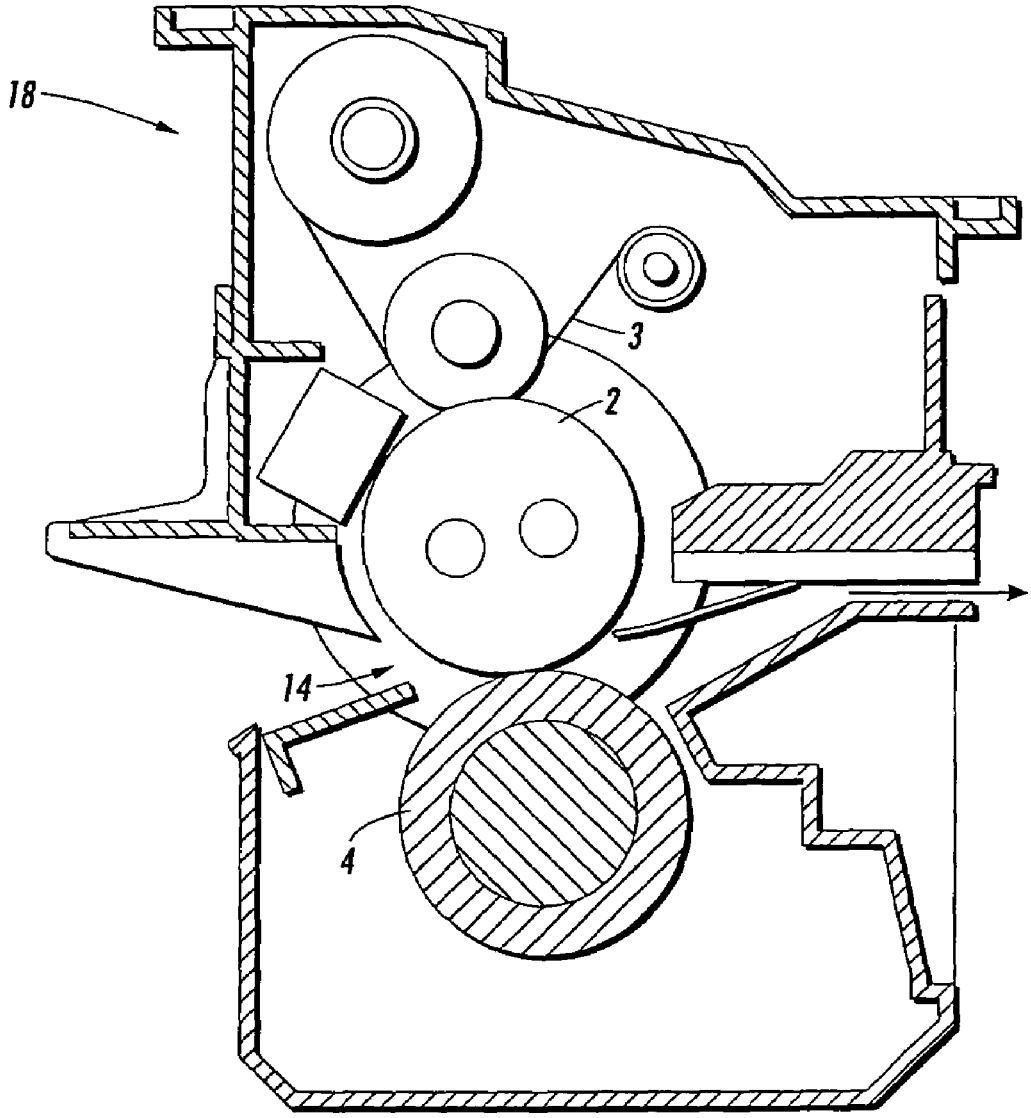
FIG. 4 illustrates an electrostatic fusing apparatus where the present charge control can be used.

In FIG. 4, a fusing system 18 is illustrated which is typical of the type apparatus where the embodiment of FIGS. 1-3 of the present invention can be used. The cleaning web 3 is shown in contact with fuser roll 2. A pressure roll 4 is also in contact with fuser roll 2 at a location substantially opposite to the location of the fuser roll-cleaning web contact point. For purposes of clarity, web and separate applicators (both chemical and electrical) are not shown in FIG. 4. FIGS. 1-3 should be consulted in this regard.

Figure 5:
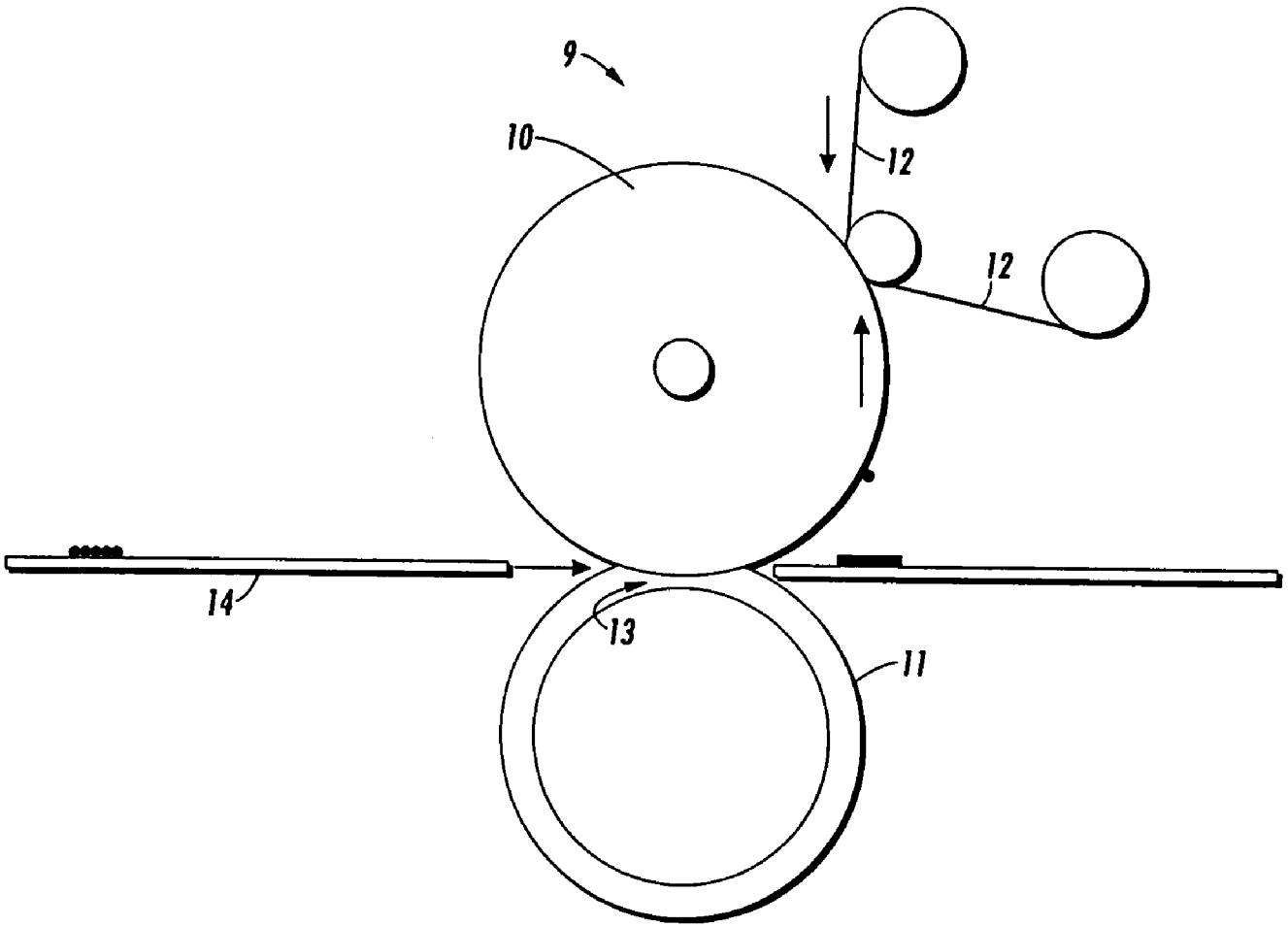
FIG. 5 (PRIOR ART)
FIG. 5 illustrates a prior art fuser system and FIG. 6 illustrates a typical electrostatic marking system useful in this invention.
Figure 6:
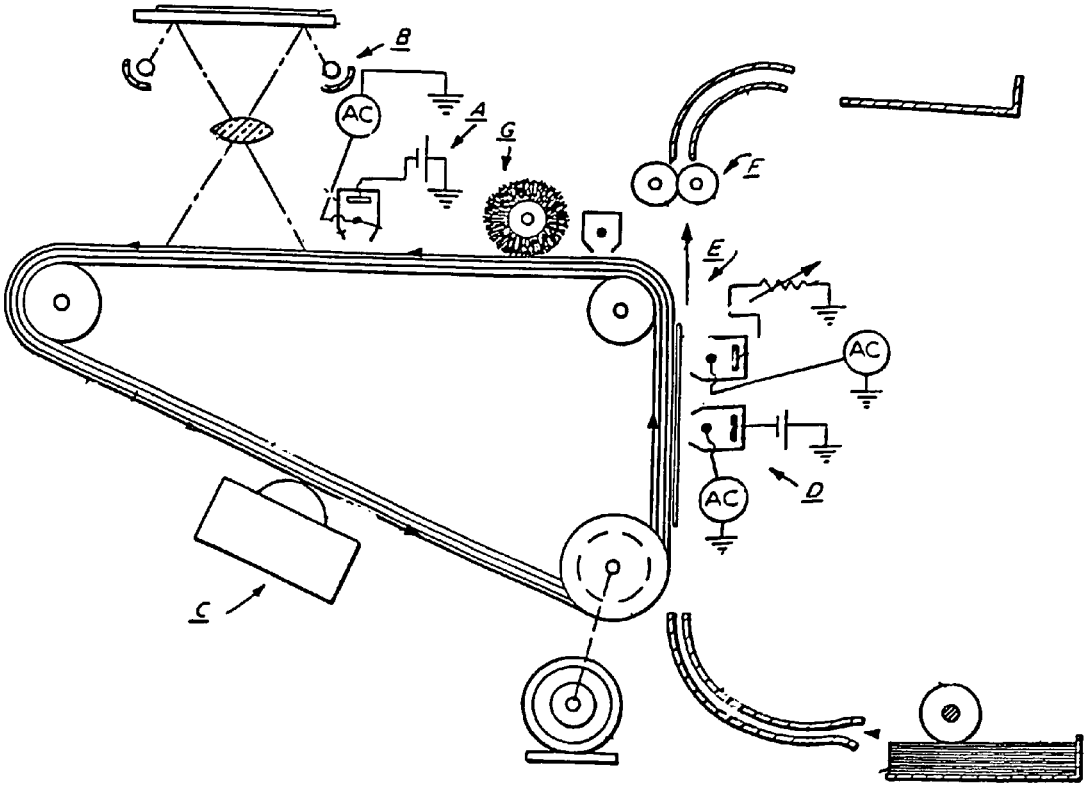

In FIG. 5, a prior art fusing system without any applicators is illustrated for a comparison with the present embodiments of FIGS. 1-4. In FIG. 5, there is no means to apply a charge to the prior art fuser roll 10 in order to control the magnitude and polarity of the voltage on the prior art fuser roll 10 surface. The prior art pressure roll 11 and prior art cleaning web 12 contacts the fuser roll 10 at about the same locations as in the present embodiments except, as noted, no charge control inducers are used in the prior art apparatus of FIG. 5. In FIG. 6 an electrostatic marking system having a charge station A, an expose station B, a development station C, a paper transfer station D, a toner supplying station C and a fuser station F, where the fuser structure of this invention is used.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A fuser structure useful in an electrostatic marking system, said fuser structure comprising in an operative arrangement, a fuser roll cleaning web, at least one fuser roll for fusing a toner, and at least one pressure roll, said fuser roll being in operative relationship with an electronic charge control inducer, said inducer enabled to modify and control a magnitude, roll voltage and polarity of said fuser roll, said fuser roll cleaning web enabled to apply a uniform wax toner release agent to said fuser roll; and wherein said uniform wax toner release agent and said toner have a charge of the same polarity.

2. An electrostatic marking system comprising a fuser roll for fixing a toner, a cleaning web, charge expose, development stations and a paper transport station, said development station comprising a toner supplying structure, said fuser roll being in operative relationship with an electronic charge control inducer, said inducer enabled to modify and control the magnitude, roll voltage and polarity of said fuser roll, said inducer adapted to at least reduce any image history effects, toner offset and marks on copy (MOC) caused by said fuser roll, said cleaning web enabled to apply a substantially uniform wax toner release agent to said fuser roll; and wherein said uniform wax toner release agent and said toner have a charge of the same polarity.

* * * * *